United States Patent [19]

Magyar et al.

[11] 4,078,922

[45] Mar. 14, 1978

[54] OXIDATION RESISTANT COBALT BASE ALLOY

[75] Inventors: Stephen Thomas Magyar, Harwinton; Emanuel Collins Hirakis, Mansfield; Maurice Louis Gell, Newington; Edward Joseph Felten, Cheshire, all of Conn.

[73] Assignee: United Technologies Corporation, Hartford, Conn.

[21] Appl. No.: 638,882

[22] Filed: Dec. 8, 1975

[51] Int. Cl.[2] ..... C22C 19/07

[52] U.S. Cl. ..... 75/171; 75/122; 75/134 F; 148/2; 148/11.5 N; 148/32

[58] Field of Search ..... 75/171, 170, 122, 134 F; 148/32, 32.5, 11.5 N, 2

[56] References Cited

U.S. PATENT DOCUMENTS 3,399,058 8/1968 Roush ..... 75/171

3,549,356 12/1970 Sims et al. ..... 75/171

*Primary Examiner*—R. Dean

*Attorney, Agent, or Firm*—Charles E. Sohl

[57] ABSTRACT

Cobalt base alloys for use at elevated temperatures are disclosed that possess excellent resistance to oxidation/-corrosion at elevated temperatures in combination with mechanical properties which exceed those of similar alloys currently in use. The resistance to oxidation/corrosion is afforded by a particular combination of aluminum and chromium which act to form a protective alumina layer and a synergistic combination of hafnium and yttrium which act to promote adherence of the alumina. Refractory metal additions are utilized to improve the mechanical properties. The alloys of the invention are suited for use in gas turbine engines as well as industrial applications such as furnaces and chemical process apparatus.

7 Claims, 9 Drawing Figures

500X

OXIDATION RESISTANT COBALT BASE ALLOY

BACKGROUND OF THE INVENTION

1. Field of the Invention

This invention relates to the field of cobalt-base alloys. Such alloys find particular use in applications such as gas turbine engines where oxidation and corrosion at elevated temperatures are problems. The present alloys may be used in cast or wrought articles and may be used uncoated in many applications.

2. Description of the Prior Art

The increasing demands for performance and efficiency which have been placed on gas turbines have been largely met by employing higher operating temperatures. These higher operating temperatures require improved materials with resistance to oxidation and corrosion at elevated temperatures in combination with good mechanical properties.

While many high temperature parts of complex geometry are produced by casting, other parts of thin and uniform cross section may most satisfactorily be produced by hot and cold working techniques. Such wrought materials are especially important where weight must be minimized.

In high temperature alloys, inherent oxidation resistance usually results from an oxide layer which forms in service. Oxidation resistance will be improved if the oxide layer can be prevented from spalling off the surface during thermal cycling. In particularly demanding environments, many alloys need further protection to provide an adequate service life. This further protection may be provided by coatings.

In most current cobalt base alloys, the oxide layer which forms is based on chromium (Cr) and generally the oxidation resistance is not sufficient to permit uncoated operation in demanding environments. Aluminum (Al) is not a common alloying addition to commercial cobalt alloys since in most cobalt alloys, the amount of Al required to provide a protective alumina layer during the life of the part is excessive and can cause problems with mechanical properties and fabricability. The excessive amount of Al required is related to the spallation of the alumina which requires that sufficient Al be present to repeatedly reform the alumina layer. This process eventually depletes the underlying alloy in Al, leading to rapid oxidation.

ASTM Special Technical Publication No. 170-A, by W. F. Simmons and V. N. Kribivobok, "Compilation of Chemical Compositions and Rupture Strengths of Super-Strength Alloys", discloses only two cobalt superalloys which contain Al, alloy M 205 which contains 2.75% Al, and alloy M 203 which contains 0.75% Al. Cobalt base alloys AR 213 and AR 215 which contain about 4% Al have been introduced but are not widely used.

Yttrium (Y) has been found to improve the oxidation resistance of certain nickel base superalloys, see for example, U.S. Pat. No. 3,202,506 which discloses the addition of Y to nickel (Ni) alloys. Coating compositions containing Y and Al in a cobalt base are known in the art, see for example U.S. Pat. No. 3,676,085 which is assigned to the present assignee. Such coating compositions are invariably brittle, because of high Y and Al levels, and have relatively low strengths. U.S. Pat. No. 3,399,058 discloses a cobalt base alloy which may contain Y greatly in excess of the solid solubility limit with the result that it contains excessive amounts of brittle, low melting phases and therefore has inferior mechanical properties and fabricability. A similar use of Y in combination with Al is found in U.S. Pat. No. 3,027,252, however the alloy disclosed has an iron (Fe) base. Belgian Pat. No. 766,596 also discloses a cobalt alloy containing Y and Al.

Hafnium (Hf) has previously been used in certain nickel base alloys, as described for example in U.S. Pat. No. 3,005,705, for the purpose of improving elevated temperature ductility but is not a common addition to cobalt base alloys.

SUMMARY OF THE INVENTION

The cobalt base superalloy of the present invention is suitable for use under demanding conditions, at elevated temperatures and has exceptional resistance to oxidation and corrosion. Further, the alloy has high mechanical properties at elevated temperatures relative to other oxidation resistant alloys. The alloy relies on a critical combination of Cr and Al to form an alumina layer which protects the alloy from further oxidation. In other alloys which form protective oxide layers spallation of the layer due to thermal stress is a problem, however, in the present alloy oxide adherence is dramatically improved by a particular synergistic combination of Hf and Y. The alloy also contains refractory metals such as tungsten (W) and tantalum (Ta) for strengthening and nonmetallic strengthening elements such as carbon (C). The alloy of the present invention, may readily be produced in cast form using well known methods such as investment casting. In a narrower composition range the alloy may be produced in wrought form, as for example, sheet and rod.

The foregoing, and other objects, features and advantages of the present invention will become more apparent in the light of the following detailed description of the preferred embodiment thereof as shown in the accompanying drawings.

DESCRIPTION OF THE PREFERRED EMBODIMENT

Figure 1:
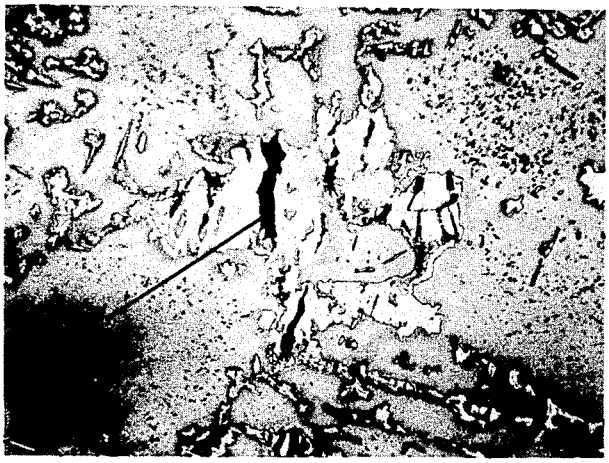
FIG. 1 shows a photomicrograph of an alloy containing excessive Y, showing cracks resulting from hot working.

In the description which follows, all compositional percentages are by weight unless otherwise specified. This invention relates to a class of cobalt base alloys which possess relatively high mechanical properties combined with exceptional oxidation and corrosion properties at elevated temperatures. Within a restricted compositional range, the alloy may be produced in wrought form and in this form is particularly useful in fabricating gas turbine engine parts such as combustion chamber walls. A critical aspect of the present invention involves the discovery that a synergistic effect occurs involving a particular relationship between Hf and Y in the presence of sufficient levels of Al and Cr to form $Al_2O_3$ in cobalt alloys. It has been found that specific quantities of these elements may be added to cobalt base alloys to improve their oxidation and corrosion resistance especially over long time periods and under conditions of thermal cycling. The mechanical properties of this class of cobalt base alloys are improved by additions of refractory metal such as molybdenum (Mo) W, Ta, columbium (Cb) and nonmetallic elements such as C and B.

Table I sets forth the broad ranges of the present alloy for fabrication in cast form and a narrower range for fabrication in wrought form. Articles such as gas turbine vanes may be produced in cast form. Alloys within the wrought range may be hot and cold worked. For the purposes of this application, wrought means material which has been reduced at least 25% in cross sectional area by hot and/or cold deformation from the cast form. The elevated temperature, mechanical, oxidation and corrosion properties of this wrought alloy are discussed below in the examples.

TABLE I

| | Cast | Wrought |
|---|---|---|
| Cr | 18–30 | 18–27 |
| Ni + Fe | 10–30 | 10–20 |
| W + Mo | 5–15 | 8–12 |
| Ta + Cb | 1–5 | 2–4 |
| C | .05–.6 | 0.25–0.45 |
| Al | 3.5–8.0 | 3.5–5.0 |
| Hf | .5–2.0 | .5–2.0 |
| Ti | 0–.5 | 0–.5 |
| Y | .02–.1 | .02–.07 |
| B | 0–.5 | 0–.5 |
| Co | Balance | Balance |

The oxidation resistance of the present alloy derives from the formation of an alumina surface layer which impedes the further diffusion of oxygen into the underlying alloy. A particular balance of Cr and Al contents is necessary for the effective development of such a layer. The lower limits on Cr and Al for satisfactory production of a protective layer are about 18 and about 3.5% respectively. On the upper end of the range, Cr levels in excess of about 30% and Al levels in excess of about 8.0% cause excessive amounts of deleterious phases in the cast form which impair the properties of the alloy. The narrower ranges for these elements in the wrought form are required for adequate fabricability. If a cobalt base alloy were produced which contained Al and Cr levels as taught above without the other elements used in the present alloy, it would be found that although initial short term cyclic oxidation performance would be probably satisfactory, long term oxidation resistance would be poor. This deficiency in long term oxidation behavior would be caused by the spallation of the alumina layer from the alloy during thermal cycling. The repeated spallation of the alumina layer causes aluminum depletion and the Al content of the underlying alloy will drop below the level required to form a protective alumina layer so that rapid oxidation will occur. The alloy of the present invention overcomes this difficulty by the use of Hf and Y in a synergistic combination which serves to promote the adherence of the alumia layer. The use of Hf and Y to promote alumina adherence permits an alloy with a low Al content, which is therefore fabricable, to form a stable alumina layer which will resist oxidation for long exposure times. In the wrought form, Y may be present in amounts in excess of the solid solubility limit, which do not cause the formation of excessive amounts of large brittle yttrides which impair fabricability and mechanical properties. These large ytrride phases are more detrimental in the wrought form than in the cast form. In the cast form, where fabricability is not a problem, a greater amount of Y may be utilized.

An ingot of a composition generally within the narrow composition range for wrought material, but having a Y content of about 0.12% was cast. This ingot cricked badly during forging and a metallographic examination revealed that the cracks originated in large yttride particles and then propagated through the remainder of the material. A photomicrograph of this material is shown in FIG. 1, in this figure, the dark areas 1 are cracks.

Hf is used in levels from about 0.5 to about 2.0%. Experiments which describe the synergism between Y and Hf will be detailed below. The alloy also contains a material chosen from the group of Fe and Ni and mixtures thereof which serves to stabilize the matix in a face centered cubic structure and to facilitate hot working. Mo and W and mixtures thereof are present as solid solution strengtheners. Mo has been found to accelerate sulfidation in other alloys, consequently it is not preferred for applications where sulfidation is a problem. Ta and Cb and mixtures thereof are also present as solid solution strengtheners and C and B (if present) serve as additional strengthening agents. Again, for the production of wrought articles the amounts of these strengthening elements must be restricted so as to provide an optimum combination of properties and fabricability A highly preferred alloy composition, for wrought articles, is listed in Table II. This highly preferred composition requires Ni as the phase stabilization element, and W and Ta as the refractory metal strengthening agents.

TABLE II

| | |
|---|---|
| Cr | 18–25 |
| Ni | 13–17 |
| W | 8–10 |
| Ta | 2–4 |
| C | 0.25–0.45 |
| Al | 3.7–4.6 |
| Hf | .5–2.0 |
| Ti | 0–.5 |
| Y | .02–.07 |
| B | 0–.5 |
| Co | Balance |

In the field of cobalt base superalloys, the refractory elements such as W and Ta are often grouped together and are usually considered to produce similar effects. In the present alloy the W level is about three times the Ta level. Experimental alloys in which the Ta level exceeded the tungsten level were found to lack hot workability.

The following process parameters have been successfully used to process the alloy of the present invention into wrought sheet form:

(1) Vacuum induction melting (VIM)
(2) Electro Slag Remelting (ESR)
(3) Homogenization at 2200°–2300° F for 12–36 hours (4) Forging at a starting temperature of 2100°-2200° F
(5) Hot rolling at a starting temperature of 2100°-2200° F
(6) Solution Heat Treatment at 2200°-2300° F for 15 minutes to 16 hours.

Of course the alloy may be used in forms other than cast and wrought. These forms include metal powders suitable for the fabrication of articles by powder metallurgy techniques, and surface deposits or layers of the alloy which may be applied by a variety of processes such as flame and plasma spraying and vapor deposition.

The elevated temperature properties of the most preferred wrought alloy of the present invention have been extensively evaluated as set forth in the following examples. In these examples, comparisons will be made with several well known commercial high temperature alloys. The nominal composition of these alloys is set forth in Table III. For consistency and simplicity in the Figures, the alloys in the examples are labeled with the letters shown in Table III. The present invention will be made clearer through reference to the following illustrative examples.

1,000 hours at 1832° F and the results are set forth in Table V. Spallation, the loss of the oxide layers, reduces the thickness of superalloys, in addition, superalloys often deteriorate because of internal oxidation, which occurs when the protective oxide layer fails. This internal oxidation is usually localized and penetrates into the underlying alloy. The column in the Table headed "Internal Oxidation" sets forth the maximum depth of internal oxidation observed from one side of the sample. The column marked "% Unaffected Metal" in Table V indicates the load bearing capability of the material after 1,000 hours of cyclic oxidation at 1832° F. This quantity "% Unaffected Metal" was determined metallographically, and is defined as original thickness minus the sum of spallation plus internal oxidation.

Comparing alloys 3 and 5 in Table V it can be seen that the presence of a very small amount of Y has a very great effect on the oxidation behaviour of the material.

Figure 2:
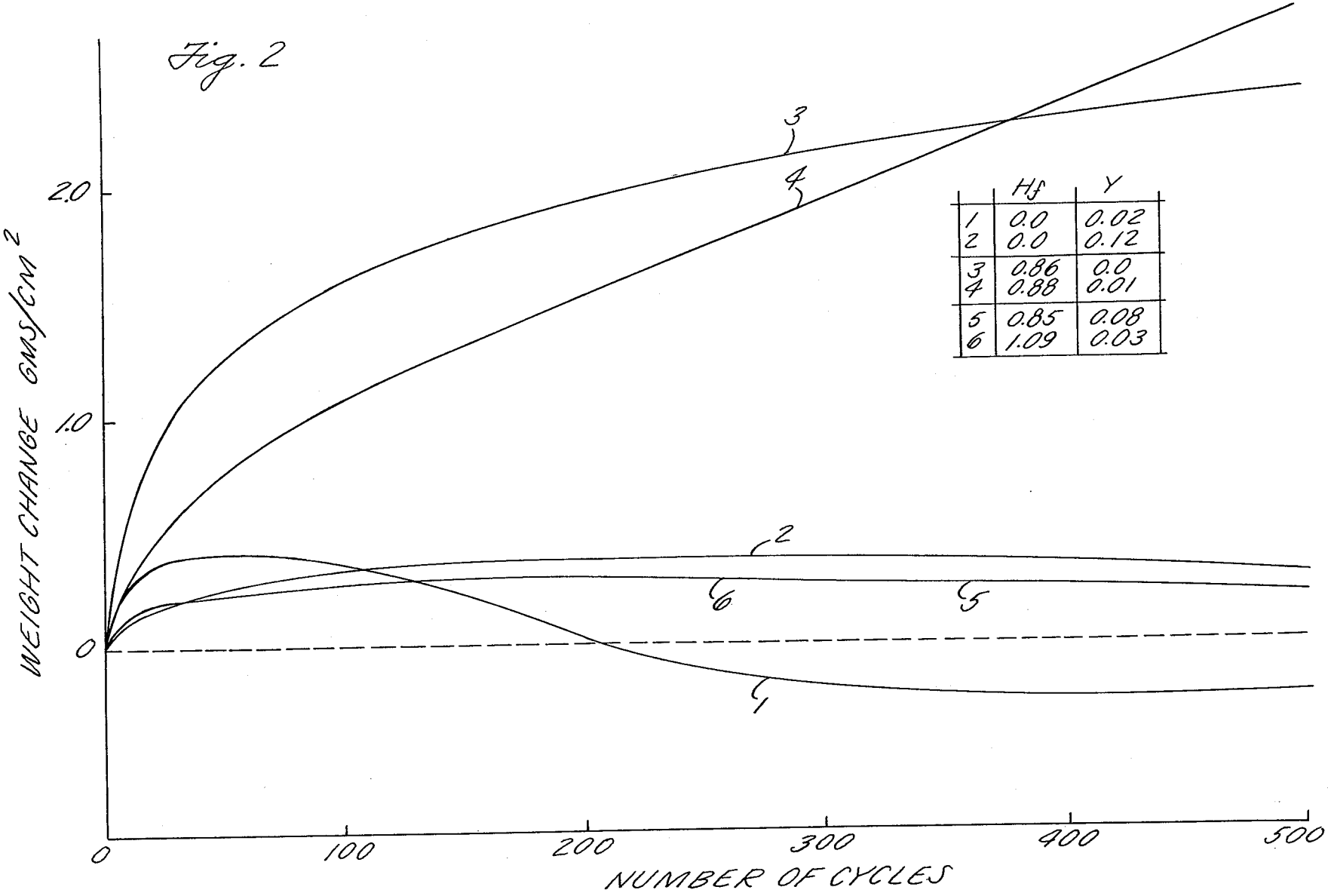
FIG. 2 shows the oxidation behavior of various alloys containing different amounts of Hf and Y.

Comparing alloys 4, 5 and 6 it can be seen that at a Hf level on the order of 1%, a Y level of at least about 0.02% is required. Comparing alloy 1 with alloy 2 it can be seen that in the absence of Hf, 0.02 is relatively ineffective in promoting oxidation resistance. Alloy 2 which contained no Hf and 0.12% Y had oxidation resistance approaching that of the alloys which contained the desired amount of Hf and Y, however, since the solid solubility limit of Y in this alloy is less than about 0.1%, the presence of 0.12% Y causes the formation of brittle yttride phases which are undesirable and adversely affect mechanical properties and the ability to fabricate wrought articles, thus by employing a combination of Y and Hf, low Y levels provide effective long term protection against spallation. FIG. 2 shows a graph of the weight change of the alloys described in Table IV as a function of time at 1832° F. An increase in weight results from formation of alumina while a decrease results from spallation of the alumina. A horizontal curve represents a desirable, stable situation. FIG. 2 indicates that a combination Y on the order of 0.02–0.08 with Hf on the order of 0.5 to 2.0 provides an alloy with oxidation resistance superior to that of an alloy containing Hf alone.

TABLE III

| | Invention Alloy (nominal wrought composition) (A) | Hastelloy X (B) | IN617 (C) | L-605 (D) | HA 188 (E) | AR-213 (F) |
|---|---|---|---|---|---|---|
| Co | Bal | 1.5 | 12.5 | Bal | Bal | Bal |
| Cr | 25.0 | 22.0 | 22.0 | 20.0 | 22.0 | 20.0 |
| Ni | 15.0 | Bal | Bal | 10.0 | 22.0 | — |
| Mo | — | 9.0 | 9.0 | — | — | — |
| W | 9.0 | .6 | — | 15.0 | 14.5 | 4.5 |
| Ta | 3.0 | — | — | — | — | 6.5 |
| C | .35 | .05 | .07 | .1 | .1 | .2 |
| Al | 4.0 | — | 1.0 | — | — | 3.5 |
| Ti | .25 | — | — | — | — | — |
| Hf | 1.2 | — | — | — | — | — |
| Y | .04 | — | — | — | — | .1 |
| La | — | — | — | — | .075 | — |
| Fe | — | 18.5 | — | — | — | — |

TABLE IV

| Alloy No. | Cr | Al | Ni | Ta | W | Ti | Hf | Y | C | Co |
|---|---|---|---|---|---|---|---|---|---|---|
| 1 | 22.3 | 4.0 | 15.6 | 2.9 | 9.3 | 0.2 | 0 | 0.02 | 0.32 | Bal |
| 2 | 24.3 | 3.9 | 14.9 | 2.9 | 8.5 | 0.2 | 0 | 0.12 | 0.33 | " |
| 3 | 24.6 | 4.0 | 15.2 | 2.8 | 9.1 | 0.2 | 0.86 | <0.005 | 0.37 | " |
| 4 | 24.5 | 4.0 | 15.0 | 2.7 | 9.0 | 0.2 | 0.88 | 0.01 | 0.36 | " |
| 5 | 25.1 | 4.0 | 14.9 | 2.7 | 8.8 | 0.2 | 0.85 | 0.08 | 0.35 | " |
| 6 | 24.2 | 4.0 | 14.8 | 2.6 | 8.8 | 0.2 | 1.09 | 0.03 | 0.35 | " |

TABLE V

| Alloy No. | Hafnium (w/o) | Yttrium (w/o) | Maximum Internal Oxidation (mils) | Percent Unaffected Metal |
|---|---|---|---|---|
| 1 | 0 | 0.02 | 13 | 58 |
| 2 | 0 | 0.12 | Negligible | 94 |
| 3 | 0.86 | 0 | 15 | 32 |
| 4 | 0.88 | 0.01 | 11 | 55 |
| 5 | 0.85 | 0.08 | Negligible | 96 |
| 6 | 1.09 | 0.03 | Negligible | 99 |

EXAMPLE I

An investigation was performed to define and illustrate the synergistic effect of Y and Hf in promoting oxide adherence. The composition of the alloys investigated are set forth in Table IV. Two commercial alloys, Hastelloy X and Haynes 188 were tested as a comparison. The alloys were tested in a cyclic oxidation test for

EXAMPLE II

Figure 3:
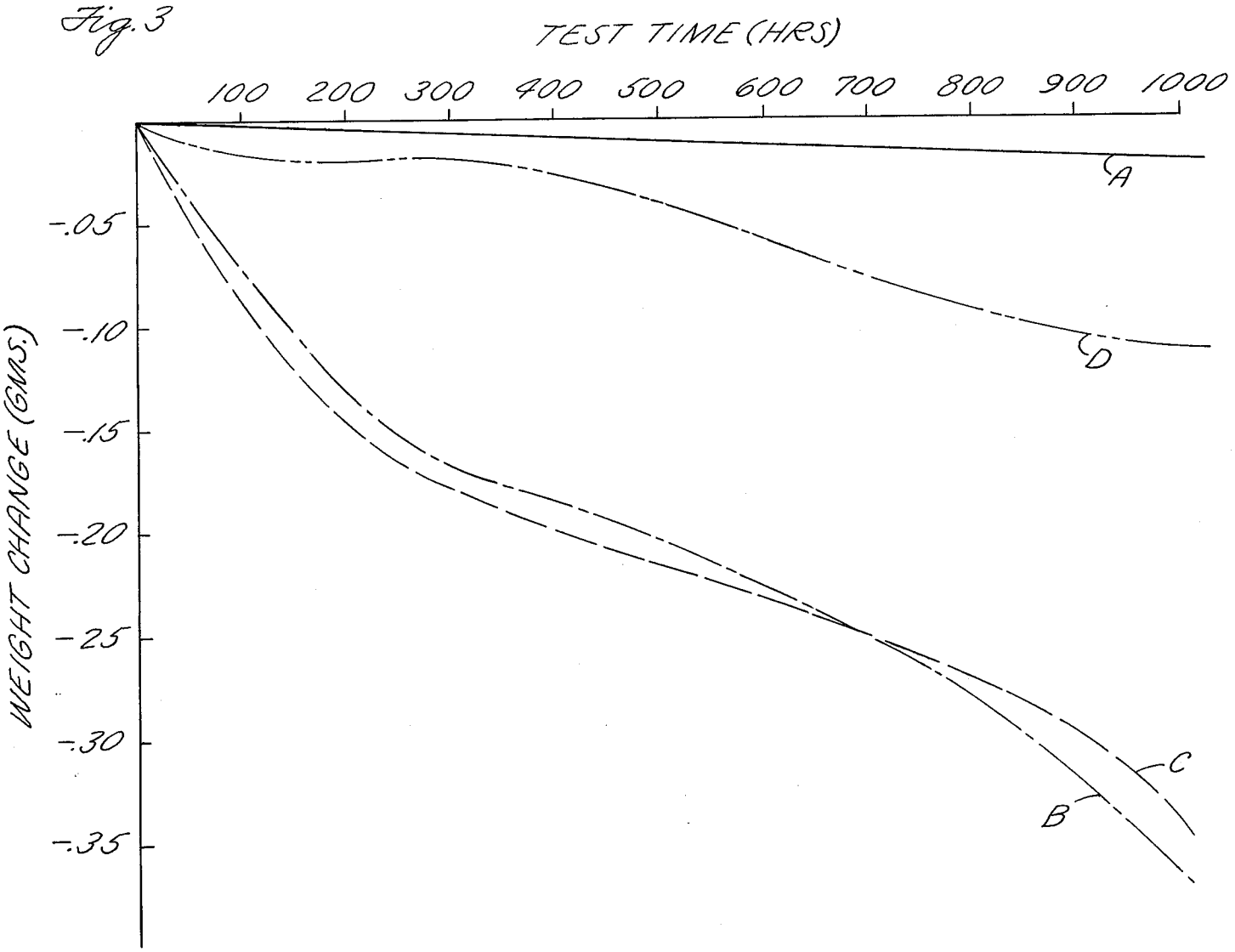
FIG. 3 shows the dynamic oxidation performance of the invention alloy and competitive alloys at 1650° F.

The oxidation properties of the present alloys were determined in a dynamic oxidation test in which a high velocity gas stream having a temperature of 1650° F was impinged on a series of samples of standard size, for a total time of 1,000 hours. The samples were removed periodically and weighed to determine weight change. An increase in weight indicates the formation of oxide material while a decrease in weight indicates oxide loss by spallation. An ideal situation is one in which the slope of the curve of weight change versus time is flat indicating the formation of a stable protective oxide layer. The following competitive alloys were tested along with the invention alloy (A): Hastelloy X (B), IN 617 (C) and L 605 (D). The results of this test are shown in FIG. 3 and it can be seen that the alloy of the present invention is significantly superior to the alloys tested. For example, after 1,000 hours the alloy of the present invention had lost only 0.020 grams while the next best alloy, alloy L 605 (D) had lost approximately 0.11 grams. Thus, in dynamic oxidation at 1650° F, the alloys of the present invention had lost less than 1/5 as much weight as the next best alloy tested.

EXAMPLE III

Figure 4:
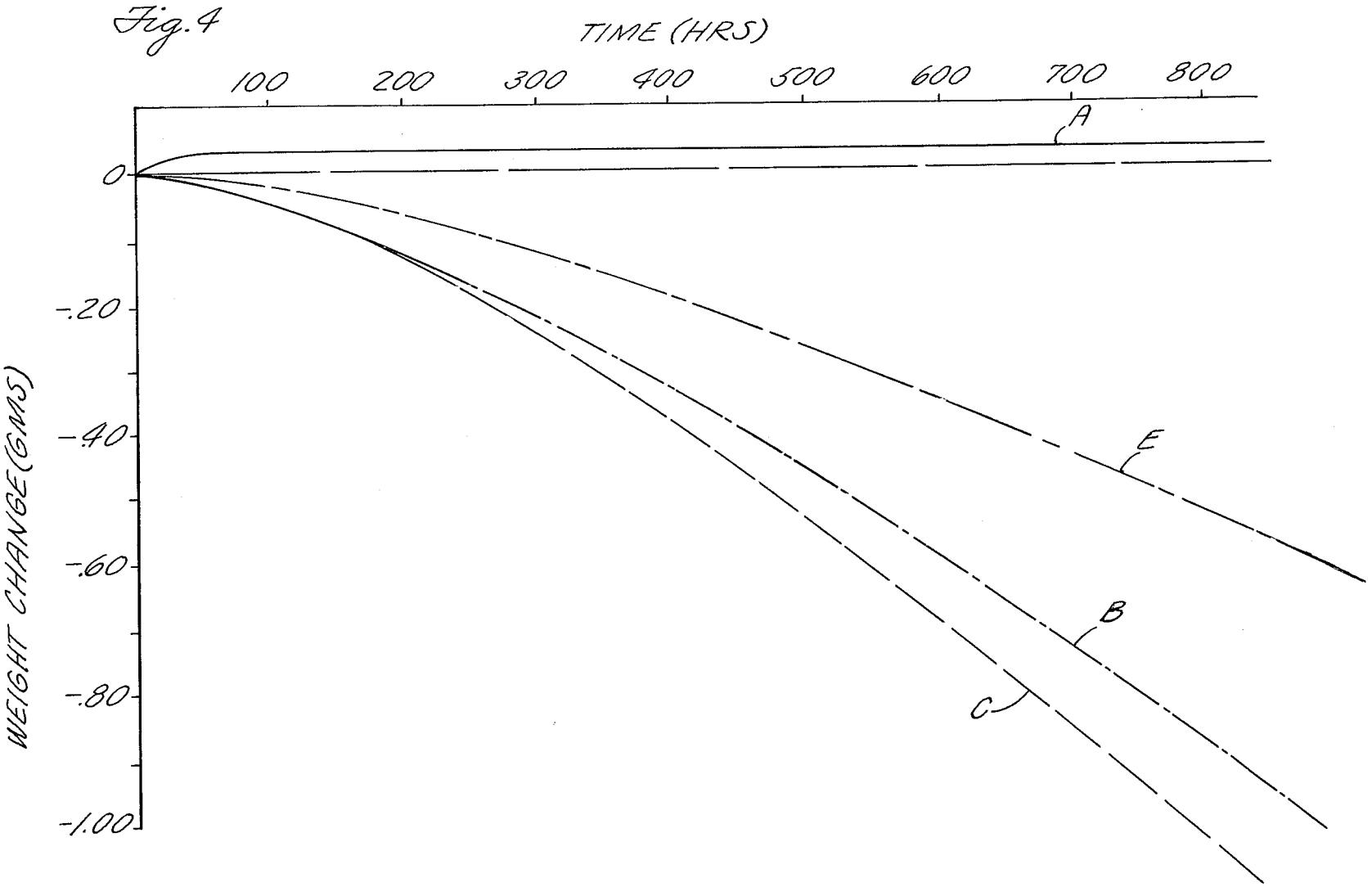
FIG. 4 shows the dynamic oxidation performance of the invention alloy and competitive alloys at 1800° F.

The procedure followed in Example II was utilized except that the test temperature was increased to 1800° F. Alloys tested included HA 188 (E), Hastelloy X (B) and IN 617 (C) as well as the alloy of the present invention (A). The results are shown in FIG. 4 and it can be seen that again at 1800° F the alloy of the present invention is significantly superior to the other commercial alloys tested for oxidation resistance. The alloy of the present invention had a slight weight gain, indicative of the formation of a stable oxide layer, while the next best alloy HA 188 (E) had a significant weight loss, indicative of significant oxidation and spallation.

EXAMPLE IV

Figure 5:
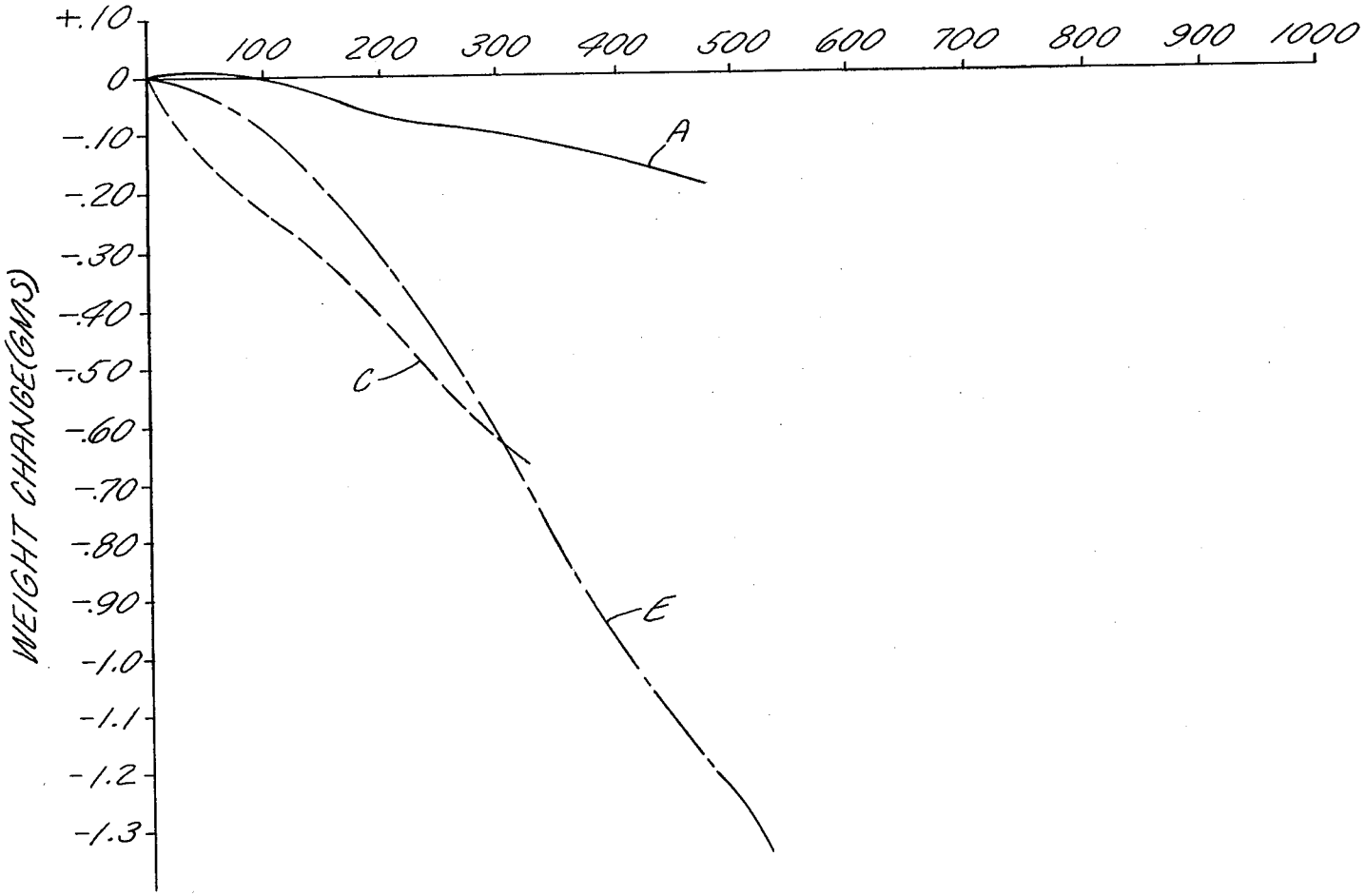
FIG. 5 shows the dynamic oxidation performance of the invention alloy and competitive alloys at 2000° F.
Figure 6:
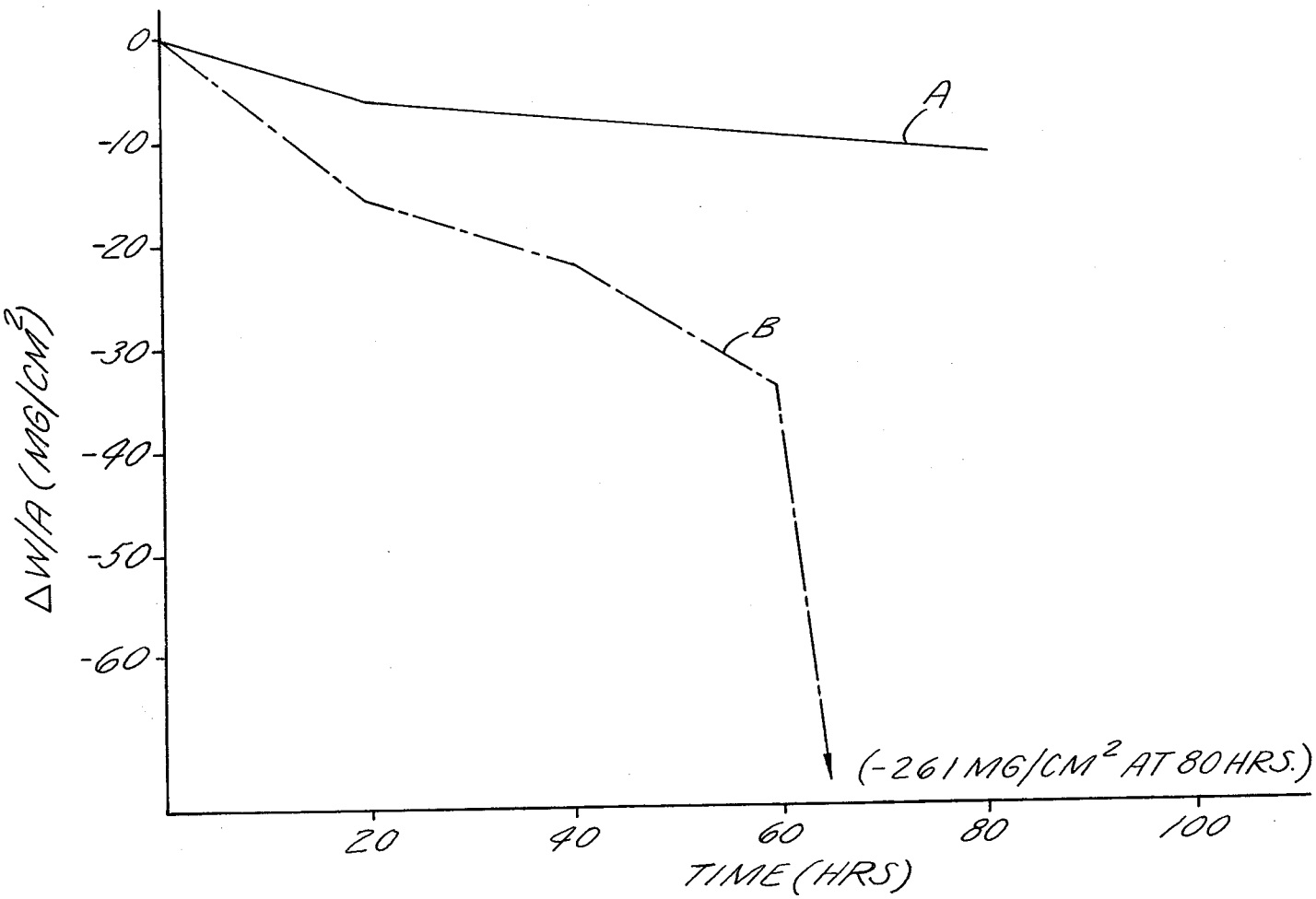
FIG. 6 shows the dynamic hot corrosion behavior of the invention alloy and competitive alloys.

The isothermal dynamic oxidation behavior of the alloy of the present invention was measured along with some comparable commercial alloys at a temperature of 2000° F using a technique similar to that previously described in Examples II and III. The other alloys tested were IN 617 (C) and HA 188 (E). The results are shown in FIG. 5. After 300 hours the alloy of the present invention had a weight loss of approximately 0.1 gram while the IN 617 (A) and HA 188 (C) sample shad weight losses of approximately 0.67 grams. Again the alloy of the present invention appears to be greatly superior to the other alloys tested.

EXAMPLE V

Figure 9:
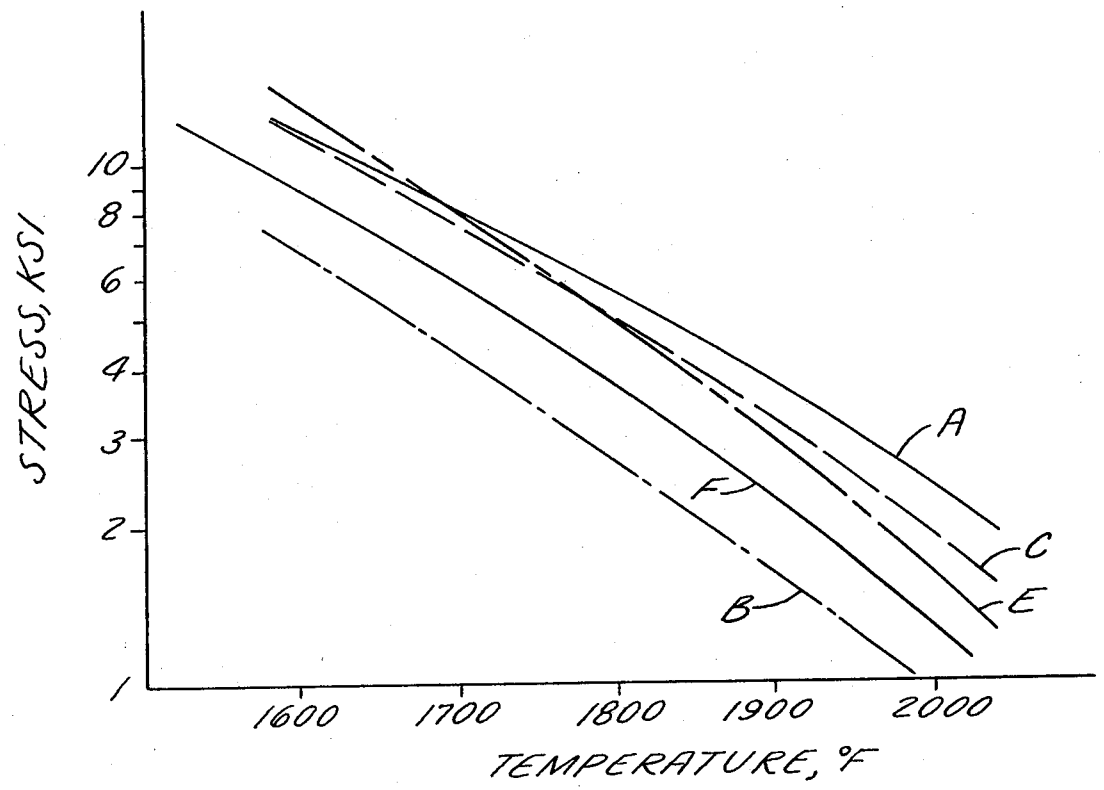
FIG. 9 shows the stress rupture properties of the invention alloy and competitive alloys as a function of temperature.

In gas turbine engines, superalloy parts suffer from hot corrosion as the result of impurities in the fuel and air. Sodium and sulfate ions have been found to be especially deleterious. The resistance of the present alloy to hot corrosion was tested as follows: samples of the invention alloy (A) (along with Hastelloy X (B)) were exposed to a stream of hot gas produced by burning petroleum based fuel. A quantity of $Na_2SO_4$ was injected into the gas stream every 20 hours to simulate actual engine operation. FIG. 9 shows the relative performance of the alloys after 80 hours of test. The invention alloy (A) has lost approximately 12 mg/cm$^2$ while the Hastelloy X (B) has lost about 261 mg/cm$^2$. Again, the alloy of the present invention appears to have better properties than the alloys used heretofore.

EXAMPLE VI

Figure 7:
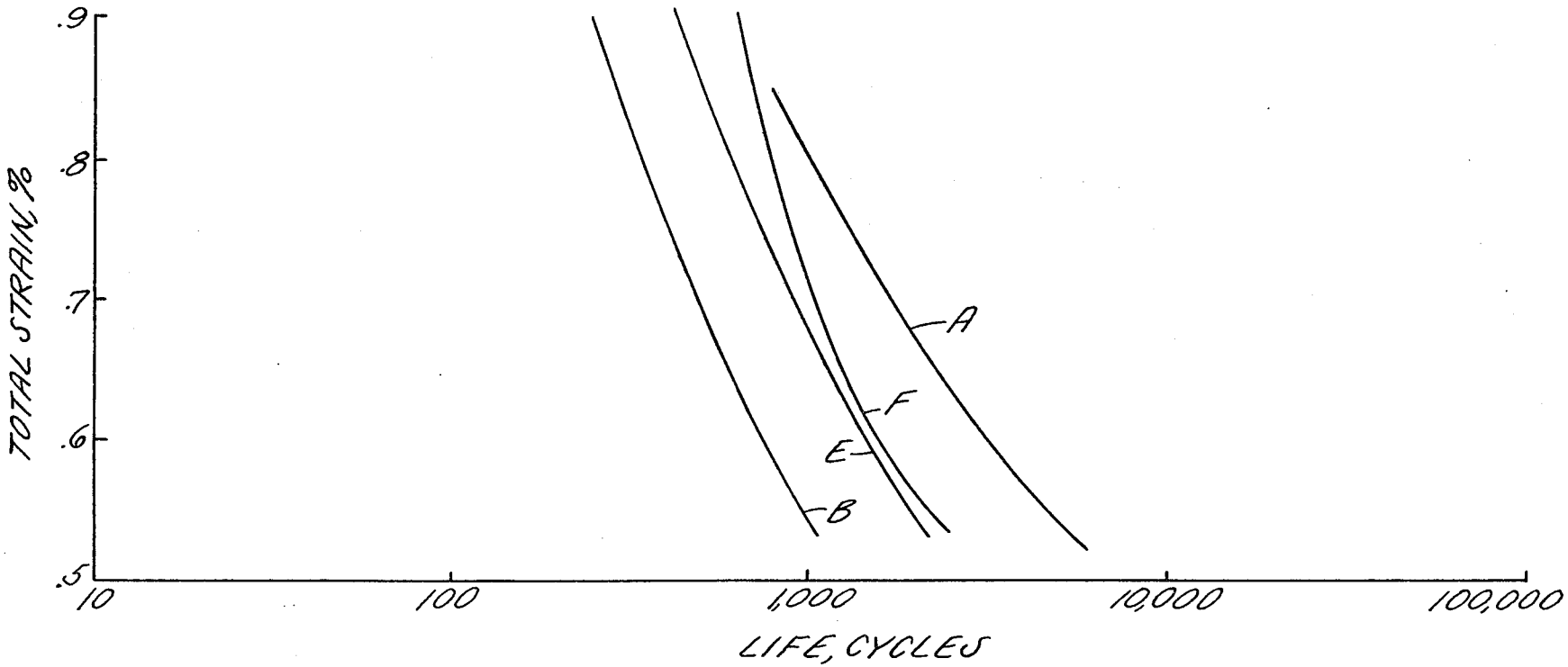
FIG. 7 shows the low cycle fatigue properties of the invention alloy and competitive alloys at 1800° F.

The low cycle fatigue (LCF) properties of the present alloy were evaluated along with the LCF properties of several competitive commercial alloys at 1800° F. The properties were measured using sheet specimens which were tested in a reversed bending test in which the total strain from the neutral position to each of the extreme positions was varied. The competitive alloys tested were Hastellloy X (B), HA 188 (E) and AR 213 (F). The results are shown in FIG. 7 and it can be seen that the alloy of the present invention (A) is superior to the other alloys tested over the strain range, at least up to 0.8%. The amount of strain appears to be representative of strains encountered in service, thus the present alloy appears to be better in LCF than the other competitive alloys.

EXAMPLE VII

Figure 8:
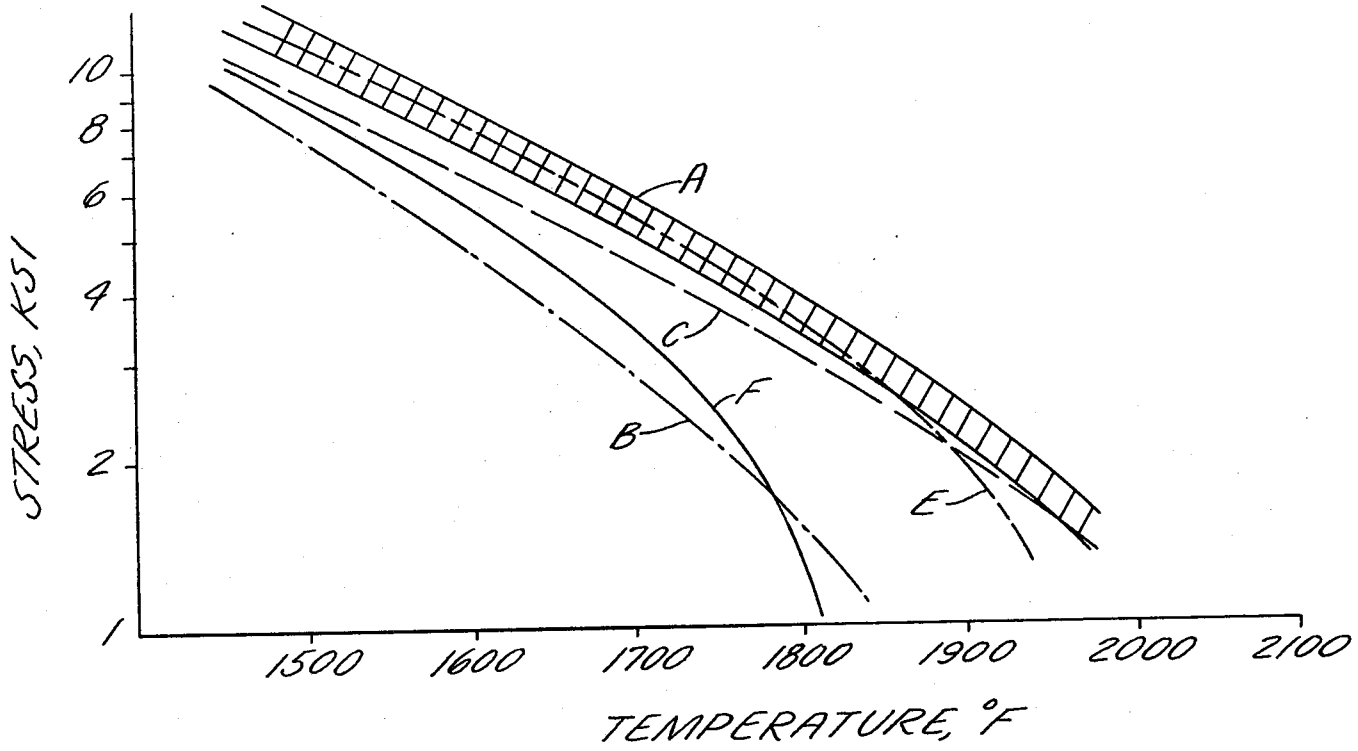
FIG. 8 shows the creep properties of the invention alloy and competitive alloys as a function of temperature.

The stress required to produce 0.5% creep strain in 150 hours was determined as a function of temperature for Hastelloy X (B), IN 617 (C), HA 188 (E), AR 213 (F) and the alloy of the present invention (A), and the results are shown in FIG. 8. The invention alloy (A) results in FIG. 8 are plotted as a band rather than a line because of the large number of tests conducted. FIG. 8 shows that the invention alloy (A) is superior to Hastelloy X (B) at all temperatures tested and is superior to IN 617 (C) up to temperatures of 1950° F. The properties of the invention alloy (A) are comparable to those of HA 188 (E) up to 1850° F while at temperatures above 1850° F, the invention alloy (A) is superior to HA 188 (E). Thus, in this test none of the commercial alloys tested was superior to the invention alloy (A) over the complete temperature range of 1500° to 1950° F.

EXAMPLE VIII

Alloys IN 617 (C), HA 188 (E), AR 213 (F) and Hastelloy X (B) were tested with the invention alloy (A) to determine the stress required to produce failure in 300 hours as a function of temperature from about 1600° F to 2000° F. The results are shown in FIG. 9. It can be seen that the invention alloy (A) required a higher stress to produce failure at temperatures above 1700° F than all other alloys tested. Below 1700° F the invention alloy is slightly inferior to Haynes 188 (E).

EXAMPLE IX

The thermal fatigue properties of the invention alloy (A) were compared with the thermal fatigue properties of Hastelloy X (B). A test was developed in which a flame at a temperature of about 1800° F was periodically impinged on a disk of sheet material with a hole in its center. The periphery of the disk was constrained to resist expansion. The number of flame heat up cycles to produce a 1/32 of an inch crack from the center hole in the disk was measured. The Hastelloy X (B) withstood approximately 1100 cycles while the invention alloy (A) disk withstood approximately 10,000 cycles. The results of this test indicate that the invention alloy (A) has superior thermal fatigue properties to Hastelloy X (B).

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. In cobalt base superalloys of the type which consist essentially of from 10% to 30% of a material chosen from the group consisting of nickel and iron and mixtures thereof, from 5% to 15% of a material chosen from the group consisting of tungsten and molybdenum and mixtures thereof, from 1% to 5% of a material chosen from the group consisting of tantalum and columbium and mixtures thereof, from 0.05% to 0.06% carbon, chromium, aluminum, balance cobalt, the improvement which comprises:

controlling the chromium level between about 18 and about 30%, and controlling the aluminum level between about 3.5 and 8.0% so as to promote the formation of an alumina layer under oxidizing conditions;

providing hafnium in an amount from about 0.5 to about 2.0% and yttrium in an amount from about 0.02 to about 0.1%, to promote adherence of the alumina layer;

whereby exceptional high temperature oxidation and corrosion resistance results.

2. A combustion chamber for use in gas turbine engines fabricated from a wrought material which consists essentially of:

from about 18 to about 27% Cr, from about 10 to about 20% of a material selected from the group consisting of Fe and Ni and mixtures thereof, from about 8.0 to about 12.0% of a material chosen from the group consisting of W and Mo and mixtures thereof, from about 2 to about 4% of a material chosen from the group consisting of Ta and Cb and mixtures thereof, from about 3.5 to about 5.0% Al, from about 0.5 to about 2.0% Hf, up to about 0.5% Ti, from about 0.02 to about 0.07% Y, from about 0.25 to about 0.45% C, up to about 0.5% B, balance essentially Co.

3. An oxidation and corrosion resistant cobalt base superalloy consisting essentially of:

from about 18 to about 30% Cr,
from about 10 to about 30% of a material chosen from the group consisting of Ni and Fe, and mixtures thereof,
from about 5 to about 15% of a material chosen from the group consisting of W and Mo and mixtures thereof,
from about 1 to about 5% of a material chosen from the group consisting of Ta and Cb and mixtures thereof,
from about 0.05 to about 0.6% C,
from about 3.5 to about 8.0% Al,
from about 0.5 to about 2% Hf,
up to about 0.5% Ti,
from about 0.02 to about 0.1% Y
up to about 0.5% B,
balance essentially Co.

4. A superalloy as in claim 3, useful for production in wrought form, which consists essentially of:

from about 18 to about 27% Cr,
from about 10 to about 20% of a material chosen from the group consisting of Ni and Fe and mixtures thereof,
from about 8 to about 12% of a material chosen from the group consisting of W and Mo and mixtures thereof,
from about 2 to about 4% of a material chosen from the group consisting of Ta and Cb and mixtures thereof,
from about 0.25 to about 0.45% C,
from about 3.5 to about 5.0% Al,
from about 0.5 to about 2.0% Hf, up to about 0.5% Ti,
from about 0.02 to about 0.07% Y,
up to about 0.5% B,
balance essentially Co.

5. A superalloy as in claim 4, which consists essentially of:

from about 18 to about 25% Cr,
from about 13 to about 17% Ni
from about 8 to about 10% W
from about 2 to about 4% Ta
from about 3.7 to about 4.6% Al.

6. A fabricable wrought cobalt base superalloy intermediate article useful for the production of further articles for use where strength and resistance to oxidation/-corrosion at elevated temperature is required, said wrought intermediate article consisting essentially of, from about 18 to about 27% Cr,
from about 10 to about 20% of a material chosen from the group consisting of Ni and Fe, and mixtures thereof,
from about 8 to about 12% of a material chosen from the group consisting of W and Mo and mixtures thereof,
from about 2 to about 4% of a material chosen from the group consisting of Ta and Cb and mixtures thereof,
from about 0.25 to about 0.45% C,
from about 3.5 to about 5% Al,
from about 0.5 to about 2% Hf,
up to about 0.5% Ti,
from about 0.02 to about 0.07% Y,
up to about 0.5% B,
balance essentially Co.

7. A process for producing a fabricable wrought cobalt base superalloy sheet including the steps of:

a. providing alloy constituents which consist essentially of:
from about 18 to about 27% Cr,
from about 10 to about 20% of a material chosen from the group consisting of Ni and Fe, and mixtures thereof,
from about 8 to about 12% of a material chosen from the group consisting of W and Mo and mixtures thereof,
from about 2 to about 4% of a material chosen from the group consisting of Ta and Cb and mixtures thereof,
from about 0.25 to about 0.45% C,
from about 3.5 to about 5% Al,
from about 0.5 to about 2% Hf,
up to about 0.5% Ti,
from about 0.02 to about 0.07% Y,
up to about 0.5% B,
balance essentially Co;

b. melting the constituents under vacuum and casting the melted constituents into ingots, c. electro slag remelting the cast ingots, d. homogenizing the remelted ingots at a temperature of from about 2200° to 2300° F for from about 12 to about 36 hours, e. forging the homogenized ingots at a starting temperature of from about 2100° to about 2200° F, f. hot rolling the forged material at a starting temperature of from about 2100° to about 2200° F, g. solution heat treating the hot rolled material at a temperature of from about 2200° to about 2300° F for a time of from about 15 minutes to about 16 hours.

* * * * *